US011219813B2

(12) United States Patent
Shin et al.

(10) Patent No.: US 11,219,813 B2
(45) Date of Patent: Jan. 11, 2022

(54) APPARATUS FOR CHECKING GOLF DIVOT

(71) Applicant: KS ELECTRONICS. CO., LTD., Daejeon (KR)

(72) Inventors: Sung Hyun Shin, Geoje-si (KR); Jin Hee Heo, Daejeon (KR); Eun Hye Park, Daejeon (KR); Hye Ji Woo, Daejeon (KR); Sun Ho Min, Asan-si (KR); Bok Cheon Mun, Daejeon (KR)

(73) Assignee: KS ELECTRONICS CO., LTD., Daejeon (KR)

( * ) Notice: Subject to any disclaimer, the term of this patent is extended or adjusted under 35 U.S.C. 154(b) by 162 days.

(21) Appl. No.: 16/491,838

(22) PCT Filed: Feb. 14, 2018

(86) PCT No.: PCT/KR2018/001984
§ 371 (c)(1),
(2) Date: Sep. 6, 2019

(87) PCT Pub. No.: WO2019/039680
PCT Pub. Date: Feb. 28, 2019

(65) Prior Publication Data

US 2021/0095948 A1 Apr. 1, 2021

(30) Foreign Application Priority Data

Aug. 23, 2017 (KR) ..... 10-2017-0106953

(51) Int. Cl.
*A63B 69/36* (2006.01)
*A63B 71/06* (2006.01)
*A63B 102/32* (2015.01)

(52) U.S. Cl.
CPC ..... *A63B 71/0622* (2013.01); *A63B 69/3661* (2013.01); *A63B 2102/32* (2015.10); *A63B 2220/833* (2013.01)

(58) Field of Classification Search
CPC ... G01B 3/14; A63B 69/3661; A63B 71/0622; A63B 2102/32; A63B 2220/833
(Continued)

(56) References Cited

U.S. PATENT DOCUMENTS 7,549,932 B1 * 6/2009 Miyamoto ..... A63B 69/3661 473/278
2003/0216189 A1 * 11/2003 Tiffin ..... A63B 69/3661 473/237

(Continued)

FOREIGN PATENT DOCUMENTS

KR 20-0310151 Y1 4/2003
KR 10-2005-0086248 A 8/2005

(Continued)

*Primary Examiner* — Nini F Legesse
(74) *Attorney, Agent, or Firm* — Novick, Kim & Lee, PLLC; Jae Youn Kim

(57) ABSTRACT

Proposed is an apparatus for checking a golf divot, which checks a position where a golf club comes into contact with the ground, a ground contact area, or a trace of the golf club when a user hits a golf ball with a golf club, so as to enable improvement of the user's swing, the apparatus including: a ball resting plate body having multiple pin-holes formed therethrough; multiple pins which are inserted into the pin-holes of the ball resting plate body, respectively, to vertically move and installed to allow upper end portions thereof to protrude upward from the ball resting plate body; and a ball resting plate body support means which supports the ball resting plate body in a state where the ball resting plate body is spaced a predetermined height apart from the ground.

7 Claims, 6 Drawing Sheets

(58) Field of Classification Search
USPC ..... 473/278, 279
See application file for complete search history.

(56) References Cited

U.S. PATENT DOCUMENTS

| | | | | |
|---|---|---|---|---|
| 2006/0128493 | A1* | 6/2006 | Snopkowski ..... | A63B 69/3661 473/278 |
| 2008/0032811 | A1* | 2/2008 | Bearden ..... | A63B 69/3661 473/278 |
| 2011/0070965 | A1* | 3/2011 | Tome ..... | A63B 69/3623 473/278 |
| 2019/0217178 | A1* | 7/2019 | Yun ..... | A63B 69/3614 |

FOREIGN PATENT DOCUMENTS

| | | | |
|---|---|---|---|
| KR | 10-0870317 | B1 | 11/2008 |
| KR | 10-2012-0033705 | A | 4/2012 |
| KR | 10-2013-0109535 | A | 10/2013 |
| KR | 10-2013-0003112 | B1 | 3/2014 |
| KR | 20-2012-0010006 | Y1 | 7/2014 |

* cited by examiner

APPARATUS FOR CHECKING GOLF DIVOT

TECHNICAL FIELD

The present invention relates to an apparatus for checking a golf divot, and more particularly to an apparatus for checking a golf divot, which checks a position where a golf club comes into contact with the ground, a contact area of the golf club with the ground, or a trace of the golf club when a user hits a golf ball with the golf club, so as to enable improvement of the user's swing.

BACKGROUND ART

In golf, a divot means a position of a small piece of the ground which is dug out by a golf club coming into contact with the ground, an area of the dug-out piece of the ground, or a trace of the golf club when a user hits a golf ball with the golf club.

By examining such a divot, the user may check whether or not the golf ball is accurately hit as he/she wants. The user may correct his/her own swing posture, a position of the golf ball, a hitting point, etc. by checking the divot. However, in general indoor and outdoor driving ranges, such information cannot be accurately acquired. Even on the ground on which a trace of the golf club can be seen, the information is only grasped to some extent.

Various golf training apparatuses and means for correcting a golf swing posture or improving swing skill have been proposed.

For example, Korean Patent Application No. 10-2013-0003112 discloses a golf swing training apparatus enabling a user to more effectively and actively practice various swing actions, such as maintenance of accuracy of a back swing, a proper interval between a golf club and a user's shoulder, a disposition state of user's two arms in the state of a two-handed grip, a speed of the back swing, maintenance of a swing path, accuracy of a follow-through, etc., when the user practices golf swings. This technology provides a configuration of maintaining a two-stage operating system in which a drive lever connected to a guide lever is mounted on a main shaft within a casing of a connection member by a fixing pin, and is thus opened at an angle of 90° with respect to the main shaft or folded to a fixing holder to be parallel to the main shaft.

Further, Korean Utility Model Application No. 20-2012-0010006 discloses a golf swing training apparatus in which a simple training tool, which is installed in a vacant space within a swing path and thus requires no separate space and does not attract other people's attention, is provided and may thus improve head-up and sway and correcting a swing path and cocking, and if a golfer takes a swing in a desirable posture, a space which is not disturbed by the swing is allocated within an oval space of a radius of about 2 m in which the golfer's body and a golf club move, a bar is installed in the allocated space, and movement of the swing axis and the center of gravity of the golfer may be checked.

As such, many efforts to improve golf swing postures have been conventionally made, but it remains difficult to take measures to improve swings by observing divots in the ground.

DISCLOSURE

Technical Problem

Therefore, the present invention has been made in view of the above problems, and it is an object of the present invention to provide a golf training apparatus which improves a swing posture using the shape, position and trace of a divot, formed in the ground by actually hitting a golf ball, so as to enable a user to improve his/her golf swing skill. In more detail, the present invention provides a golf training apparatus which may be easily installed and used in a driving range, at home or at an office.

Technical Solution

In accordance with the present invention, the above and other objects can be accomplished by the provision of an apparatus for checking a golf divot, including a ball resting plate body having multiple pin-holes formed therethrough, multiple pins configured to be inserted into the pin-holes of the ball resting plate body, respectively, to be raised and lowered and installed to allow upper end portions thereof to protrude upwards from the ball resting plate body, a ball resting plate body support means configured to support the ball resting plate body in a state in which the ball resting plate body is spaced apart from the ground by a predetermined height, a sensing unit installed under the pins and configured to sense lowering of the pins and to generate a signal, a pin returning means configured to raise the pins to their original state, when the pins are lowered by a stroke of a golf club, and a display unit configured to visually express data sensed by the sensing unit.

The sensing unit may include a sensing board installed under the ball resting plate body to be parallel thereto, and press switches installed at positions on the sensing board at which the pins are installed so that the pins descend and thus lower ends thereof press the press switches.

The apparatus may further include a pin guide means installed between the ball resting plate body and the sensing unit to guide vertical movement of the pins.

The apparatus may further include a foot supporter having the same height as an installation height of the ball resting plate body.

The pin returning means may include elevation plates configured to support the sensing unit and provided with lower ends comprising inclined surfaces, horizontal movement plates provided with lower ends comprising inclined surfaces contacting the lower ends of the elevation plates and moved in a horizontal direction, and a horizontal movement unit installed at a side of the horizontal movement plates and configured to horizontally move the horizontal movement plates so as to raise and lower the elevation plates.

The pin returning means may include a turf mat having artificial turf installed thereon, a first rubber plate installed under the turf mat, and a lower support plate configured to support the first rubber plate, and pin-holes formed through the first rubber plate may have a diameter smaller than a diameter of the pins so as to slightly constrict the pins when the pins are raised and lowered.

A protrusion may protrude from an intermediate part of each pin so as to limit a vertical movement range of the pin.

Advantageous Effects

By the above-described configuration, if a golf club hits a golf ball in a state in which the pins protrude from the upper surface of the ball resting plate body, pins located at a position where the golf club passes through the ball resting plate body are lowered due to an impact. The sensing mean senses the lowered pins and indicates such a position through various monitors, thereby visually expressing a divot. A user may improve and study his/her own swing by analyzing the divot displayed on the monitors.

BEST MODE

The present invention provides an apparatus for checking a golf divot, including a ball resting plate body having multiple pin-holes formed therethrough; multiple pins configured to be inserted into the pin-holes of the ball resting plate body, respectively, to be raised and lowered and installed to allow upper end portions thereof to protrude upwards from the ball resting plate body; a ball resting plate body support means configured to support the ball resting plate body in a state in which the ball resting plate body is spaced apart from the ground by a predetermined height; a sensing unit installed under the pins and configured to sense lowering of the pins and to generate a signal; a pin returning means configured to raise the pins to their original state, when the pins are lowered by a stroke of a golf club; and a display unit configured to visually express data sensed by the sensing unit.

MODE FOR INVENTION

Hereinafter, embodiments of the present invention will be described in detail with reference to the accompanying drawings.

Figure 1:
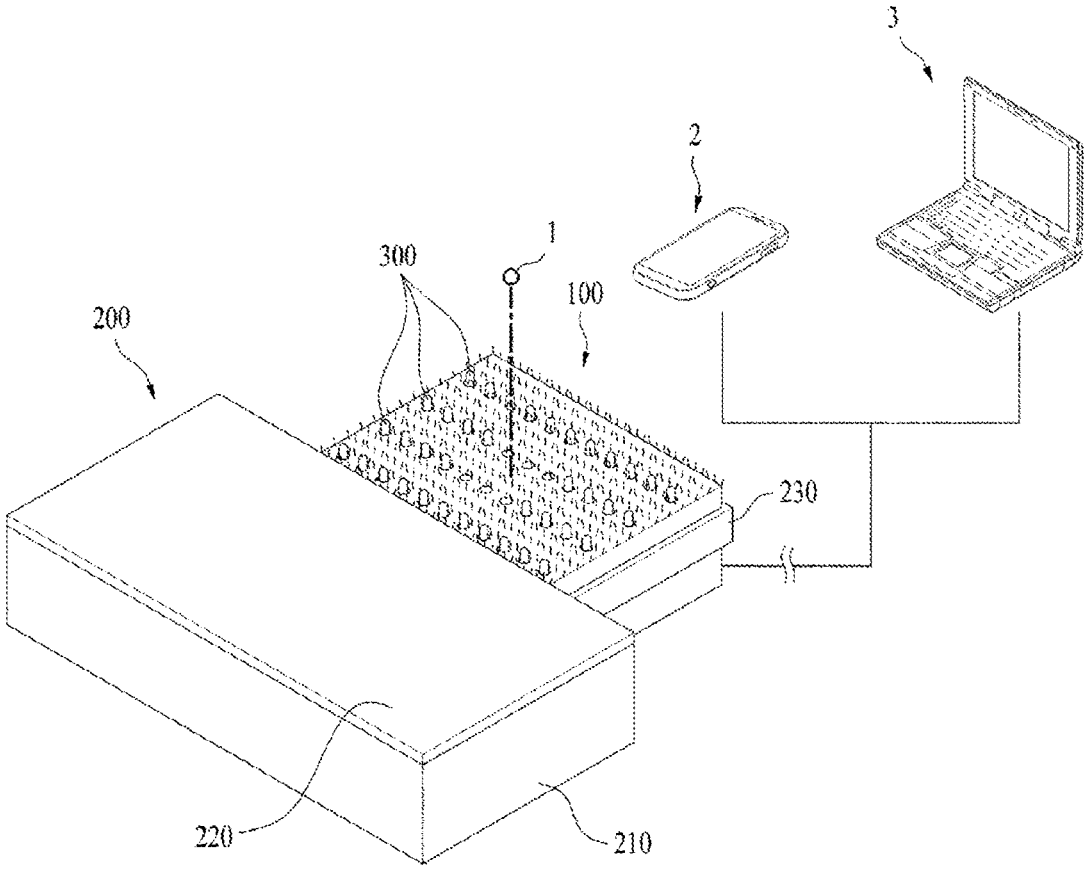
FIG. 1 is an overall perspective view of an apparatus for checking a golf divot in accordance with one embodiment of the present invention.

First, an overall apparatus will be described with reference to FIG. 1. FIG. 1 is an overall perspective view of an apparatus for checking a golf divot in accordance with one embodiment of the present invention.

The apparatus in accordance with the present invention include a main body 100 on which a golf ball 1 may be placed, and a foot supporter 200 provided at one side of the main body 100. These elements may be installed in an integrated manner, or be provided in a separate manner. The latter case, portability may be increased. Even in the separate manner, movement of the main body 100 must be prevented when a user hits the golf ball, and thus, when the apparatus is used, the foot supporter 200 and the main body 100 may be fixed to each other by a designated holder 230. Artificial turf is installed on the entirety or a part of the upper surface of the main body 100. The main body 10 is connected to a display unit, such as a smartphone 2 or a computer (or a monitor) 3, by wires or wirelessly.

Figure 2:
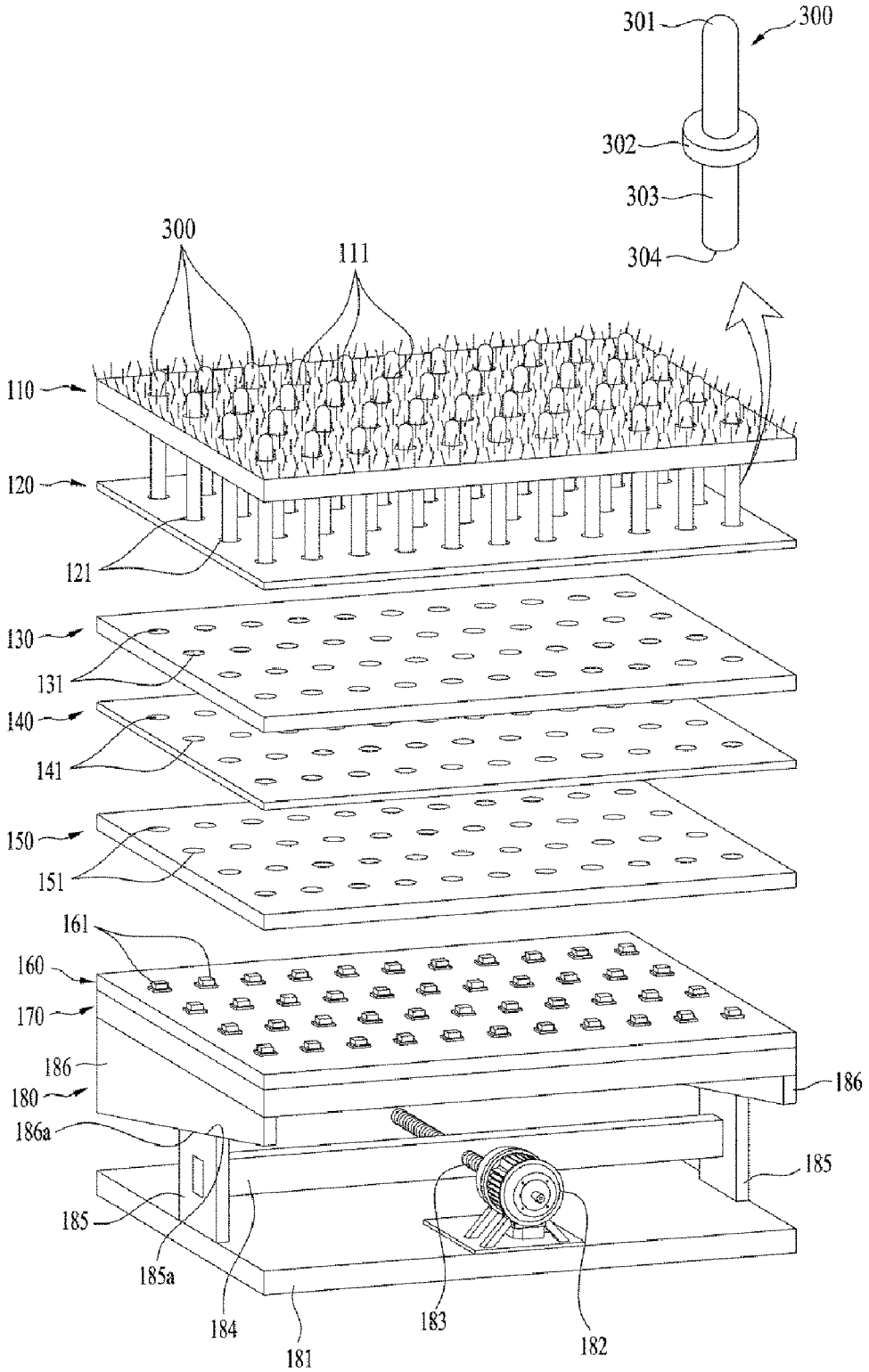
FIG. 2 is an exploded perspective view illustrating the layered structure of the apparatus in accordance with one embodiment of the present invention.
Figure 3:
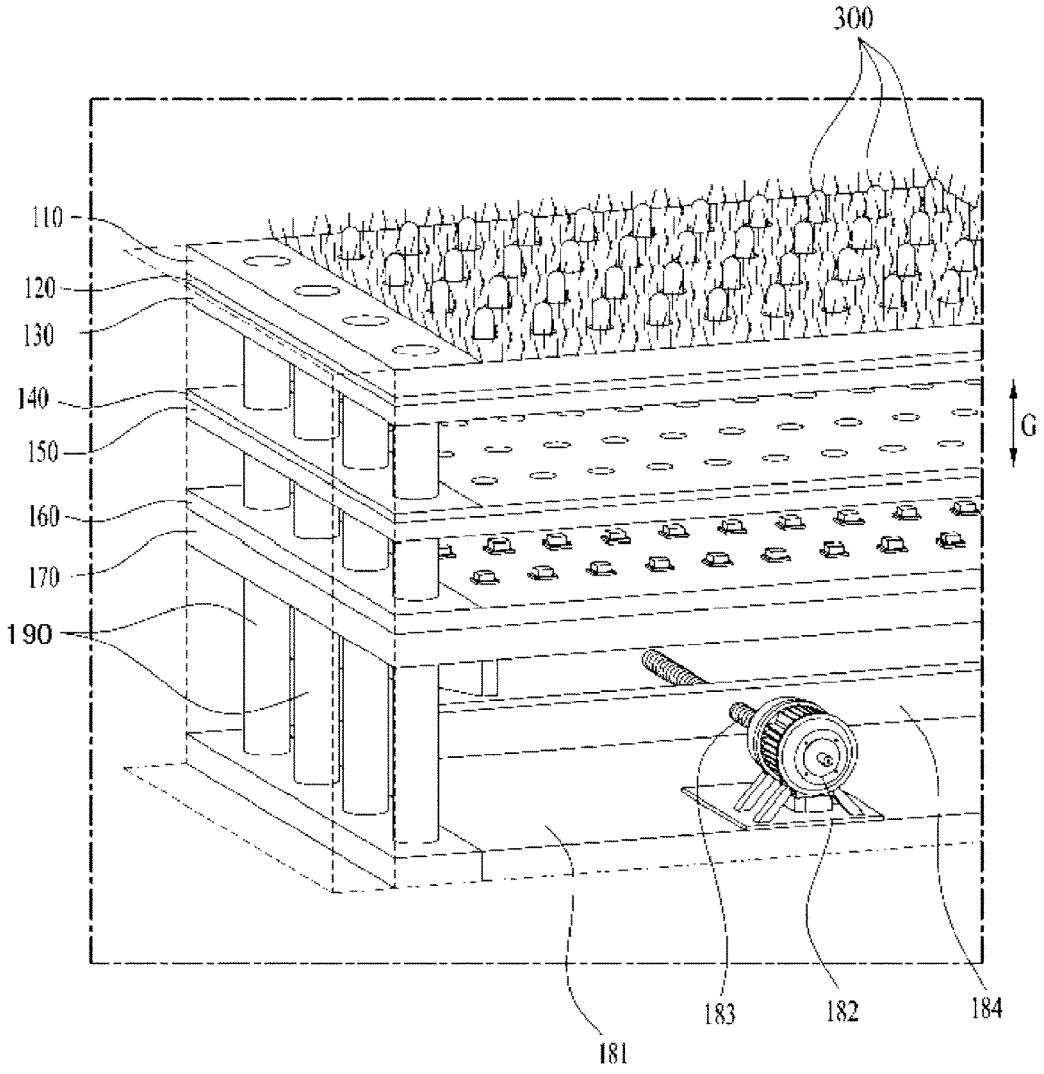
FIG. 3 is an overall perspective view of the apparatus in accordance with one embodiment of the present invention.
Figure 4:
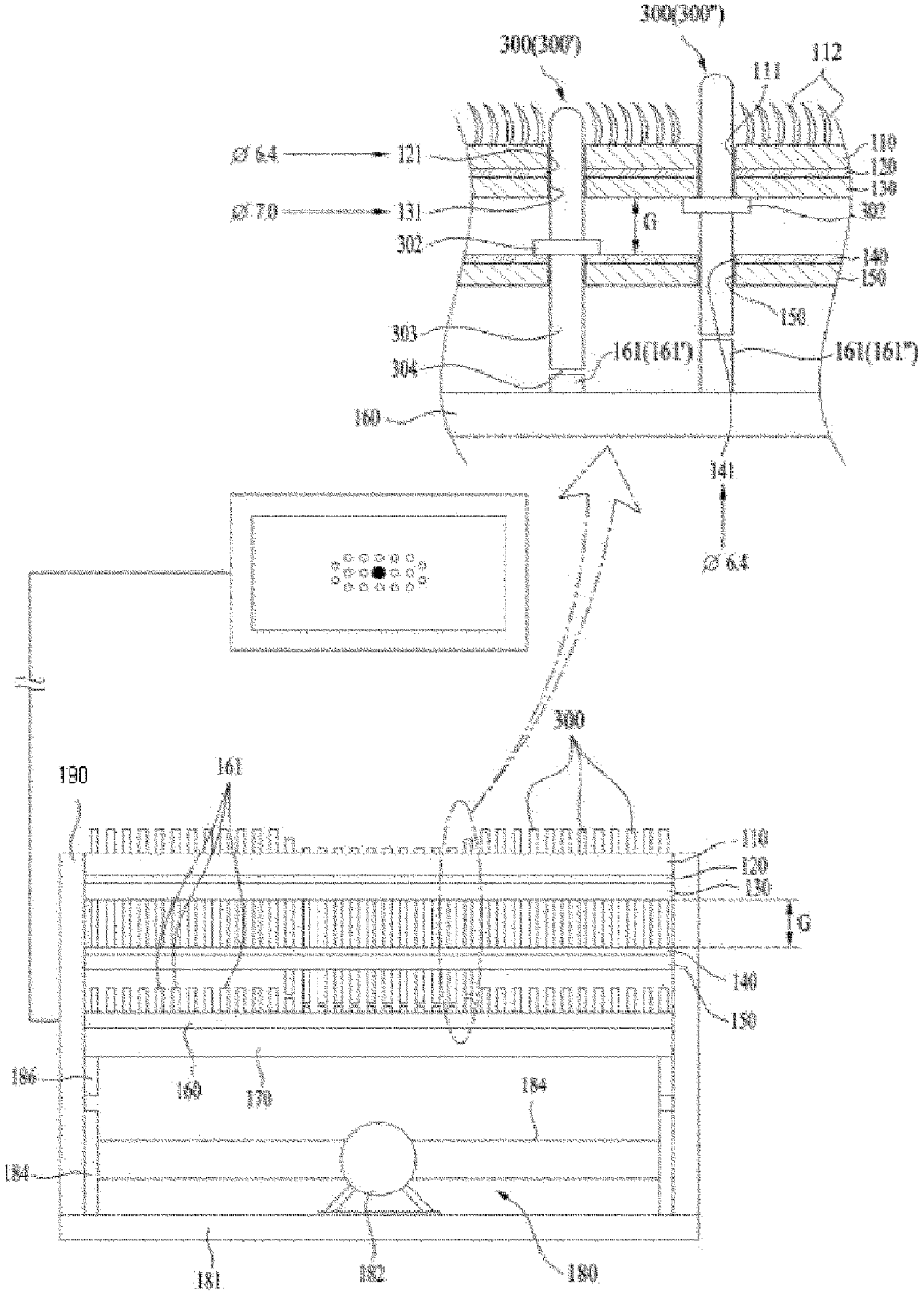
FIG. 4 is a cross-sectional view of the apparatus in accordance with one embodiment of the present invention.
Figure 5:
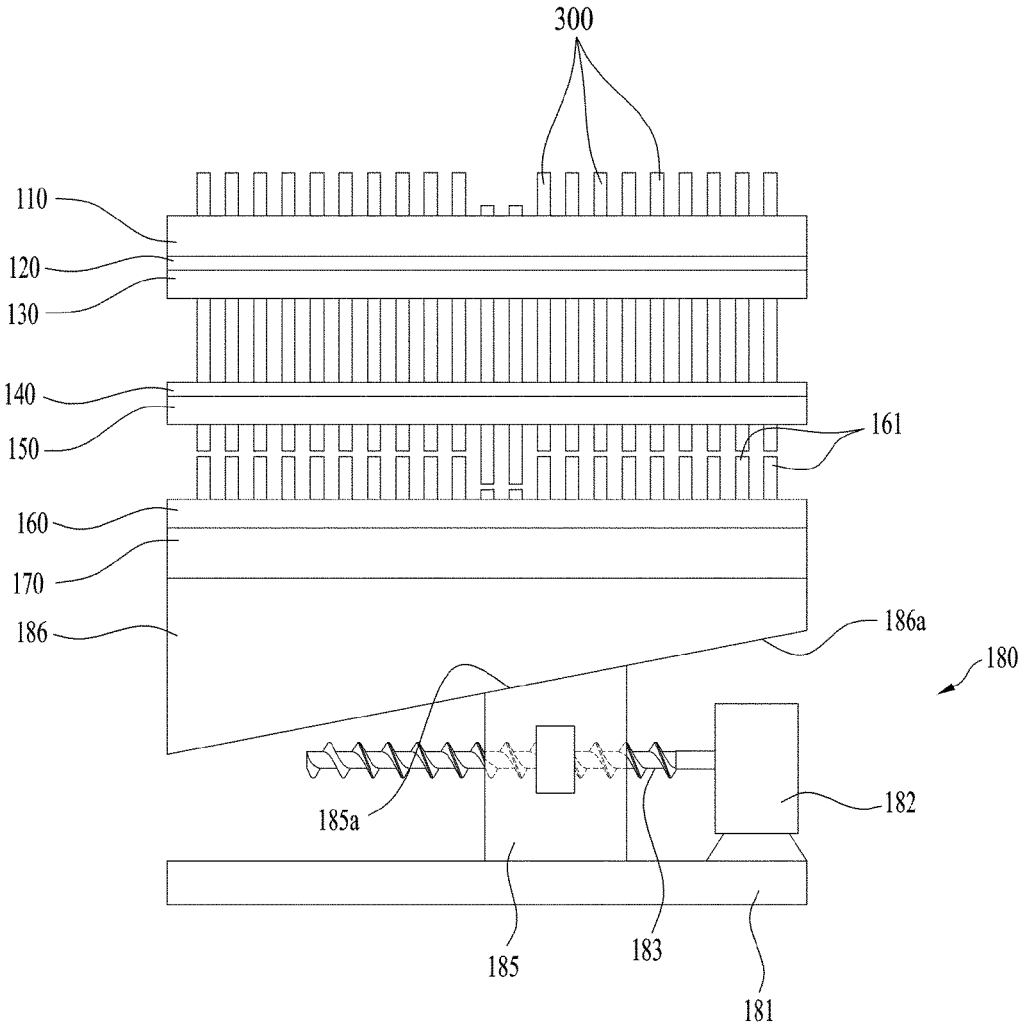
FIGS. 5 and 6 are cross-sectional views illustrating the operating state of a pin returning means of the apparatus in accordance with one embodiment of the present invention.
Figure 6:
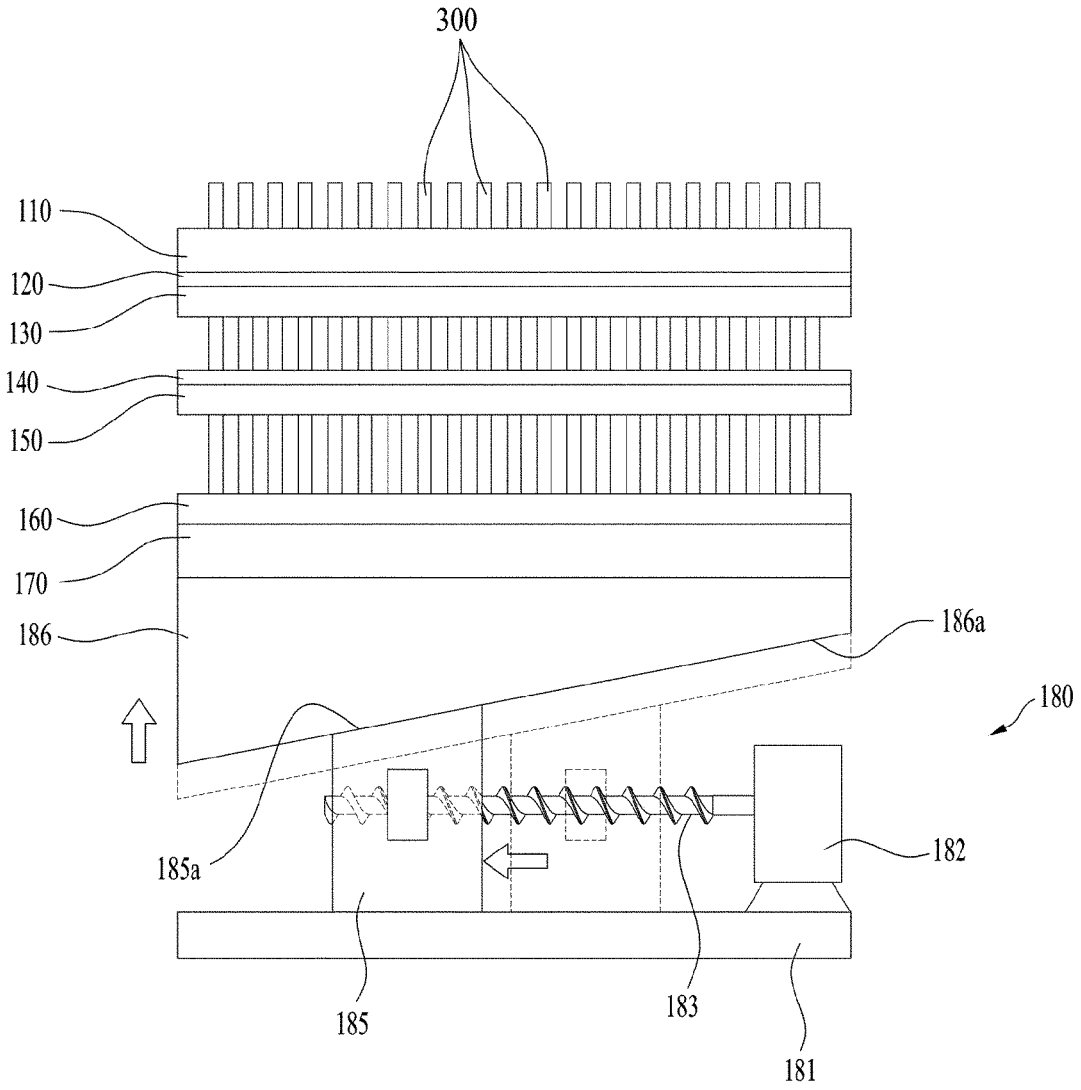

Hereinafter, the configuration and functions of the main body 100 will be described with reference to FIGS. 2 to 5. FIG. 2 is an exploded perspective view illustrating the layered structure of the apparatus in accordance with one embodiment of the present invention, FIG. 3 is an overall perspective view of the apparatus, and FIG. 4 is a cross-sectional view of the apparatus. FIG. 5 is a cross-sectional view illustrating the functions of a pin returning means.

Multiple pin-holes 111, 121 and 131 are formed through a ball resting plate body 110, 120 and 130 located at the upper portion of the main body 100. Artificial turf is provided on the surface of the ball resting plate body 110, 120 and 130. The ball resting plate body 110, 120 and 130 may include a turf mat 110 having artificial turf installed thereon 112, a first rubber plate 120 installed under the turf mat 110, and a lower support plate 130 supporting the first rubber plate 120. These elements may be combined into one unit, or may be provided separately so that the turf mat 110 may be replaced, when needed.

Multiple pins 300 are inserted into the respective pin-holes 111, 121 and 131 so as to be raised and lowered. The pins 300 are installed such that upper end portions thereof protrude upwards from the ball resting body 110, 120 and 130. The pins are elements colliding with a golf club and are formed of a strong material, such as PC. Upper ends 301 of the pins 300 are rounded. The pins 300 are formed as rods having a designated length and a protrusion 302 protrudes from an intermediate part of each pin. The number of the pins 300 may be adjusted. For example, 200-400 pins 300 may be installed, and the diameter of the pins 300 may be 6.5 mm. The pins 300 may be spaced apart from each other by intervals of 5-10 mm in the length and width directions. Of course, these numerical values do not limit the scope of the invention.

A ball resting plate body support means serves to support the ball resting plate body 110, 120 and 130 in a state in which the ball resting plate body 110, 120 and 130 is spaced apart from the ground by a designated height. The ball resting plate body support means is illustrated in FIG. 3. A description thereof is provided below.

A sensing unit 160 and 170 is installed under the pins 300. The sensing unit 160 and 170 senses lowering of the pins 300 due to the impact of a golf club (not shown) and then generates a signal. The sensing unit 160 and 170 may include a sensing board 160 installed under the ball resting plate body 110, 120 and 130 and parallel thereto so as to be spaced apart from the the ball resting plate body 110, 120 and 130, and press switches 161 installed at positions on the sensing board 160 at which the pins 300 are installed so that the pins 600 are lowered and thus lower ends thereof press the press switches 161. The press switches 160 generates a signal when the pins 300 from above press or touch the press switches 160 in the same manner as a keyboard of a computer, and are installed so as to correspond to the pins 300 one to one. The sensing board 160 may include a circuit board. The sensing board 160 may be supported by a board support plate 170.

The display unit visually expresses a signal generated due to sensing through the sensing unit 160 and 170, i.e., a divot signal. The display unit may be the smartphone 2 or the monitor of the computer 3, as shown in FIG. 1, or an electronic display board. It will be apparent to those skilled in the art that the divot signal may be output through various methods.

A pin returning means 180 raises the pins 300 to their original state (from a state of FIG. 5(*a*) to a state of FIG. 5(*b*)), when the pins are lowered by a stroke of a golf club placed on the ball resting plate body. The pin returning means may be configured in various manners. In accordance with this embodiment, rotary force of a drive motor 182 installed under the sensing unit 160 and 170 is used. That is, the pin returning means includes elevation plates 186, horizontal movement plates 185, and a horizontal movement unit.

The elevation plates 186 support the sensing unit 160 and 170, and lower ends 186*a* thereof include inclined planes. The elevation plates 186 are fixed to the lower surface of the board support plate 170. The horizontal movement plates 185 are installed under the elevation plates 186 so as to be in contact with the elevation plates 186. Upper ends 185*a* of the horizontal movement plates 185 include inclined surfaces contacting the lower ends 186*a* of the elevation plates. That is, the lower ends 186*a* of the elevation plates and the upper ends 185*a* of the horizontal movement plates contact each other at an angle of inclination. In order to reduce frictional force of a contact surface thereof, a lubrication means may be intervened. A solid lubricant may be used or metal rails may be used as the lubrication means.

Lower ends of the horizontal movement plates may be installed on a bottom plate 181 so as to be horizontally rectilinearly movable. Bottom rails (not shown) may be provided on the bottom plate 181 so that the horizontal movement plates 185 may be horizontally moved. Thereby, when the horizontal movement plates 185 are horizontally moved in a direction forming a right angle with the inclined planes, the elevation plates 186 are vertically moved. The horizontal movement unit horizontally moves the horizontal movement plates 185.

The horizontal movement unit includes the drive motor 182 fixedly installed on the upper surface of the bottom plate 181, a screw rod 183 connected to an output shaft of the drive motor 182 via a reducer, and a movable bar 184 screwed to the screw rod 183 and provided with both ends connected to the horizontal movement plates 185. The movable bar 184 is horizontally moved by axial rotation of the screw rod 183. Of course, a lubrication means, such as a bearing, may be installed at a connection part between the screw rod 183 and the movable bar 184. The drive motor 182 may be a servomotor which may be rotated only at a desired RPM for a desired time.

In accordance with one embodiment of the present invention, a pin guide means to guide vertical movement of the pins 300 may be further installed between the ball resting plate body 110, 120 and 130 and the sensing unit 160 and 170.

The pin guide means 140 and 150 may include a guide plate 150 provided with pin-holes 151 formed throughout the surface thereof so as to correspond to the pins 300 one to one, and a second rubber plate 140 placed on the upper surface of the guide plate 150. Pin-holes 141 may be formed through the second rubber plate 140 so as to correspond to the positions of the pins 300.

Hereinafter, the ball resting plate body support means will be described with reference to FIG. 3. Lower ends of vertical guide rods 190 are fixed to the bottom plate 181, and upper ends of the vertical guide rods 190 are supported by the ball resting plate body 110, 120 and 130. The vertical guide rods 190 are provided in a plural number, and are installed at each of both sides of the ball resting plate body 110, 120 and 130. The pin guide means 140 and 150 and the sensing unit 160 and 170 are installed such that they may be raised and lowered in the vertical direction along the vertical guide rods 190. Of course, the pin guide means 140 and 150 and the sensing unit 160 and 170 are simultaneously raised and lowered by driving of the drive motor 182. The sensing unit 160 and 170 and the pin guide means 140 and 150 are fixed in a state in which they are spaced apart from each other by a designated distance.

In accordance with one embodiment of the present invention, the pins 300 may be limited so that they are raised and lowered only within a designated section. The protrusion 302 protrudes from the intermediate part of each pin 300 in the radial direction. The protrusions 302 prevent the pins 300 from passing through the respective pin-holes 111, 121, 131, etc., and are located in a space between the ball resting plate body 110, 120 and 130 and the pin guide means 140 and 150. Therefore, as shown in FIG. 4, the pins may be vertically moved by only a distance corresponding to a gap G between the ball resting plate body and the pin guide means. The reason for this is to prevent the pins 300 from damaging the sensing board 160 due to excessive lowering of the pins 300, and to prevent the pins 300 from being separated upwards from the ball resting plate body 110, 120 and 130.

In addition, a movement limiting means for preventing the pins 300 from being too easily raised and lowered is provided. The movement limiting means may include the above-described first and second rubber plates 120 and 140, and the pin-holes 121 and 141 provided in the first and second rubber plates 120 and 140 may have a diameter slightly smaller than the diameter of the pins 300 and thus slightly constrict the outer circumferential surfaces of the pins 300 so as to avoid arbitrary movement of the pins 300. For example, the diameter of main bodies 303 of the pins may be 6.5 mm, and the diameter of the pin holes 121 and 141 of the first and second rubber plates 120 and 140 may be 6.4 mm. The first and second rubber plates 120 and 140 may have a thickness of about 3 mm, and may of course be formed of an elastic material, such as urethane, in addition to rubber. For reference, the pin-holes 111, 131 and 151 of the turf mat 110, the support plate 130 and the guide plate 150 may have a diameter slightly greater than the diameter of the pin main bodies 303 so that the pins 300 may smoothly pass through the pin-holes 111, 131 and 151. For example, the diameter of the pin-holes 111, 131 and 151 may be 7 mm.

As another feature of the present invention, the apparatus may further include the foot supporter 200 having the same height as the installation height of the main body 100. The foot supporter 200 enables a surface on which the user steps and the upper surface of the ball resting plate body 110, 120 and 130 to be located at the same height. The foot supporter 200 may include a support 210 and a support plate 220 placed on the upper surface of the support 210. These elements may be provided to be separable, and in order to increase portability, the support 210 may be formed in a foldable manner so that the volume thereof may be minimized. An anti-sliding means may be installed on the upper surface of the support plate 220.

Hereinafter, the functions of the apparatus in accordance with the present invention will be described mainly referring to FIGS. 4 and 5.

When a user places a golf ball 1 at the center of the ball resting plate body 110, 120 and 130, in a state in which all of the pins 300 protrude from the upper surface of the ball resting body 110, 120 and 130, gets on the foot supporter 200 and takes a swing, a golf club hits the ball 300 and simultaneously passes through the pins 300. That is, an impact is applied to pins 300' which the golf club contacts. Thereby, the corresponding pins 300' are lowered and operate corresponding press switches 161' of the sensing unit, thereby generating a signal. Then, the display unit visually expresses a divot, as shown in FIG. 4, through a designated program. Press switches 161" corresponding to pins 300", which are not touched by the golf club, do not generate a signal.

When a position of the upper surface of the ball resting plate body 110, 120 and 130, at which the golf ball 1 is placed, is determined and the determined position is input to the program, the position, area and trace of a divot together with the position of the golf ball 1 may be expressed. Thereby, the user may analyze his/her own swing and make improvements. The position at which the golf ball 1 is placed may be distinguished from other regions by installing no pins 300 at the position or marking the position.

When the user takes a swing, the corresponding pins 300' are lowered and the divot is displayed, the drive motor 182 is operated in response to user's instructions or automatically to raise the sensing unit, lower ends 304 of the pins 300' are pushed up and thus the pins 300' are returned to the position of other pins 300". Then, the drive motor 182 is rotated in reverse and returns the sensing unit 160 and 170 to its original position. That is, the apparatus is reset and thus stands by for the next swing.

Although not shown in the drawings, elastic bodies, such as springs, may be used as the pin returning means. They serve to elastically return the pins after the pins temporarily press the press switches. The springs may be coil springs installed such that one end of each coil spring is supported by the pin 300 and the other end of each coil spring is supported by the sensing unit 160 and 170 or the pin guide means 140 and 150.

The above description is merely an example based on the technical scope of the invention. Although the exemplary embodiments of the present invention have been disclosed for illustrative purposes, those skilled in the art will appreciate that various modifications, additions and substitutions are possible, without departing from the scope and spirit of the invention as disclosed in the accompanying claims. For example, it will be understood that the above-described embodiments can be freely combined by those skilled in the art and that any combinations are encompassed in the scope of the invention.

INDUSTRIAL APPLICABILITY

The present invention is applicable to the field of an apparatus for checking a golf divot which checks a position where a golf club comes into contact with the ground, a contact area of the golf club with the ground, or a trace of the golf club when a user hits a golf ball with the golf club, so as to enable improvement of the user's swing.

The invention claimed is:

1. An apparatus for checking a golf divot, comprising:

a ball resting plate body having multiple pin-holes formed therethrough;

multiple pins configured to be inserted into the pin-holes of the ball resting plate body, respectively, to be raised or lowered, and installed to allow upper end portions thereof to protrude upwards from the ball resting plate body;

a ball resting plate body support means configured to support the ball resting plate body in a state in which the ball resting plate body is spaced apart from the ground by a predetermined height;

a sensing unit installed under the pins, and configured to sense lowering of the pins and to generate a signal;

a pin returning means configured to raise the pins to their original state, when the pins are lowered by a stroke of a golf club; and a display unit configured to visually express data sensed by the sensing unit.

2. The apparatus according to claim 1, wherein the sensing unit comprises:

a sensing board installed under the ball resting plate body to be parallel thereto; and press switches installed at positions on the sensing board at which the pins are installed so that the pins are lowered and thus lower ends thereof press the press switches.

3. The apparatus according to claim 1, further comprising a pin guide means installed between the ball resting plate body and the sensing unit to guide vertical movement of the pins.

4. The apparatus according to claim 1, further comprising a foot supporter having the same height as an installation height of the ball resting plate body.

5. The apparatus according to claim 1, wherein the pin returning means comprises:

elevation plates configured to support the sensing unit and provided with lower ends comprising inclined surfaces;

horizontal movement plates provided with lower ends comprising inclined surfaces contacting the lower ends of the elevation plates and movable in a horizontal direction; and a horizontal movement unit installed at a side of the horizontal movement plates and configured to horizontally move the horizontal movement plates so as to raise and lower the elevation plates.

6. The apparatus according to claim 1, wherein the pin returning means comprises:

a turf mat having artificial turf installed thereon; a first rubber plate installed under the turf mat; and a lower support plate configured to support the first rubber plate, wherein pin-holes formed through the first rubber plate have a diameter smaller than a diameter of the pins so as to slightly constrict the pins when the pins are raised or lowered.

7. The apparatus according to claim 1, wherein a protrusion protrudes from an intermediate part of each pin so as to limit a vertical movement range of the respective pin.

* * * * *